US006598262B2

(12) United States Patent
Farina

(10) Patent No.: US 6,598,262 B2
(45) Date of Patent: Jul. 29, 2003

(54) HIGH PRESSURE PRINTING PRESS CLEANER

(76) Inventor: Michael Farina, 6 Chestnut St., Greenvale, NY (US) 11548

( * ) Notice: Subject to any disclaimer, the term of this patent is extended or adjusted under 35 U.S.C. 154(b) by 93 days.

(21) Appl. No.: 09/867,681

(22) Filed: May 30, 2001

(65) Prior Publication Data

US 2002/0184729 A1 Dec. 12, 2002

(51) Int. Cl.[7] ..... A47L 5/36; A47L 7/00; A47L 9/02

(52) U.S. Cl. ..... 15/321; 15/322

(58) Field of Search ..... 15/314, 321, 322, 15/401

(56) References Cited

U.S. PATENT DOCUMENTS

| | | | | |
|---|---|---|---|---|
| 3,940,826 | A | | 3/1976 | Phillips et al. |
| 4,337,784 | A | | 7/1982 | Goerss |
| 4,580,309 | A | * | 4/1986 | Ogden |
| 4,606,092 | A | | 8/1986 | Henning |
| 5,048,148 | A | | 9/1991 | Glendall |
| 5,125,126 | A | * | 6/1992 | Bonnant |
| 5,493,753 | A | | 2/1996 | Rostamo |
| 5,706,548 | A | | 1/1998 | Schabacker |
| 5,718,015 | A | * | 2/1998 | Rohrbacher |
| 5,752,289 | A | | 5/1998 | Collins |
| 5,815,869 | A | | 10/1998 | Hopkins |
| 5,907,887 | A | | 6/1999 | Mansur |
| 5,970,574 | A | * | 10/1999 | Thrash |
| 5,991,968 | A | * | 11/1999 | Moll et al. |
| 6,302,967 | B1 | * | 10/2001 | Rohrbacher et al. |

* cited by examiner

*Primary Examiner*—Terrence R. Till
(74) *Attorney, Agent, or Firm*—Michael I. Kroll

(57) ABSTRACT

The present invention 10 discloses a high pressure printing press ink cleaner comprising a vacuum header housing 20 having wheels 22 secured thereon for mobility. A water supply conduit 24 is connected at one end through connection means 26 to the housing 20 and at the other end to an external power washing device 16. The cleaning unit 14 has a head 74 thereon which contains power spray jets 62 whereby fluid spray 68 is ejected onto a surface to be cleaned. The dirty fluid is sucked up by suction ports 72 contained in the vacuum head 74 and returned through hose 64 to a wet vac 18 where it is stored in the tank 19 of the wet vac. An operator handle 28 is shown having a control trigger means 30 thereon which controls the release of the fluid and the amount of fluid to be released. An embodiment is also shown comprising a vacuum extension tube 78 passing through multiple areas of a building having multiple connectors for the inlet water line 82 and vacuum ports 80 whereby one power washer 16 and wet vac 18 can be used to clean several areas simultaneously.

7 Claims, 9 Drawing Sheets

HIGH PRESSURE PRINTING PRESS CLEANER

BACKGROUND OF THE INVENTION

1. Field of the Invention

The present invention relates generally to portable surface cleaning devices and more specifically to high pressure water surface cleaning apparatus. The apparatus of the present invention consisting of a vacuum header housing having secured wheels adjacent to the lower surface of the housing. A conduit is secured to the housing and at one end the conduit may be coupled to an external power washer device. At the other end of the conduit contains power spray jets whereby fluids may be ejected to the surface of a printing deck and may be mixed with a cleaning fluid for the purpose of cleaning printers ink from said surface. An operators handle extrudes from the housing and contains a fluid release control valve in which the operator may control the amount of fluids released. A suction port is also contained on the housing. The suction port is coupled to an external wet vac system by means of a vacuum hose. The wet vac draws the discharge fluids up through the housing suction port and storing said fluid in a wet vac holding tank external from the device of the present invention.

2. Description of the Prior Art

There are other portable surface cleaning apparatus designed for cleaning deck surfaces. Typical of these is U.S. Pat. No. 3,940,826 issued to Paul Phillips on Mar. 2, 1976.

Another patent was issued to William Goerss et al. on Jul. 6, 1982 as U.S. Pat. No. 4,337,784. Yet another U.S. Pat. No. 4,606,092 was issued to John J. Henning on Aug. 19, 1986 and still yet another was issued on Sep. 17, 1991 to Robert Gleadall as U.S. Pat. No. 5,048,148.

Another patent was issued to Gary Rostamo on Feb. 27, 1996 as U.S. Pat. No. 5,493,753. Yet another U.S. Pat. No. 5,706,548 was issued to Nolan Schabacker on Jan. 13, 1998. Another was issued to Dale T. Collins on May 19, 1998 as U.S. Pat. No. Des. 5,752,289 and still yet another was issued on Oct. 6, 1998 to John M. Hopkins et al. as U.S. Pat. No. 5,815,869.

Suction is generated by a blower at the rear of the recovery chamber and a shield positioned in front of the blower prevents liquid from being drawn from the recovery chamber into the blower. A pump removes liquid in the recovery chamber through a hose which empties into a remote drain. A parallel pump tubing causes recycle of liquid through the pump whenever liquid in the recovery chamber is depleted to prevent dry running of the pump. A set of spray nozzles located in the apparatus just behind the suction nozzle is connected through a hose to a faucet which acts as a remote source of clean water. The clean water supply tubing connects to the nozzles through a positive flow additive injector. The clean water supply tubing is also directly connected to the recovery tank through a bypass tubing so as to further aid in preventing dry operation of the pump and to cause additive flow even when source water pressure is low. The blower is shrouded so that air is the specification discloses a surface cleaning apparatus having a molded plastic housing and an upwardly and rearwardly projecting casing terminating at a handle, the lower portion of the housing including a forward suction nozzle, opening into a recovery chamber evacuated downwardly from the blower into the surface being cleaned. A conveniently located handle switch is wired such that whenever clean water and additive are being sprayed onto the floor, the pump also operates. A separate switch enables one to run the pump only in the event the recovery tank gets too full.

A high-pressure water cleaning device has an enclosure with an open bottom for movement over a floor surface and floor gratings. The cleaning device may be stationary, with objects to be cleaned moved past the enclosure. A rotating seal includes an upright spindle within said enclosure and secured thereto having an axial bore with a high-pressure water inlet and a series of radial discharge ports. A rotatable tubular body is journalled upon said spindle and has an internal annular high-pressure chamber communicating with the discharge ports and a series of radial outlets communicating with the chamber. Tubular arms mounting nozzles are laterally projected into said outlets for rotation with the body, the nozzles being adjusted for delivering streams of high pressure water within the enclosure at high pressure onto floor surfaces and gratings. The tubular body is power rotated. A high pressure dump valve assembly upon the enclosure receives high pressure water from a high pressure water source and has a normal mode zero pressure outlet orifice communicating with the interior of the spray enclosure and a high pressure active mode outlet which communicates with the spindle inlet for delivering high pressure water thereto. Paint is removed from floor and floor grating surfaces by directing a stream of high pressure water from said nozzles toward said surfaces. Rotation of the tubular body and closure of the dump valve outlet orifice are effected simultaneously by pneumatic activation of the cleaning device.

The disclosed spray-vacuum tool has a partitioned housing with two adjacent open faces, and defines adjacent liquid and vacuum chambers each open to both open housing faces. A pair of squeegees project beyond the open housing faces from opposite housing sides paralleling the partition and each squeegee is angled across a sharp angle corresponding to the corner angle. A pair of end guides also project beyond the open housing faces from the other interconnecting housing sides, and the squeegee ends are butted flush against the end guides. Each end guide has a flat edge to be fitted flush against one of the respective surfaces to be cleaned, and the squeegees then are flexed then against the surfaces to be cleaned. This communicates the chambers together in the region adjacent the surfaces to be cleaned, but isolates this region from the tool exterior. Nozzle means in the liquid chamber spray washing and/or rinsing liquid directly against the surfaces to be cleaned; and a source of vacuum is connected, via a hollow wand swiveled at one end to the housing, to the vacuum chamber operable to draw away the liquid spray and dirt kicked up by the spray. A brush also having the angled corner shape is supported in the liquid chamber immediately adjacent the squeegee.

A carpet cleaning apparatus consisting of a housing having a lower surface and an interior cavity. Wheels are secured adjacent to the lower surface of the housing. A conduit is secured to the housing. The conduit has a first end whereby the conduit may be coupled to a water supply and a second end with spray jets whereby fluids may be injected into a carpet. A discharge tank is secured within the interior cavity of the housing. The discharge tank has two suction ports, and two fluid inlets. Two suction conduits are provided. Each suction conduit has a first end communicating with one of the fluid inlets of the discharge tank and a second end disposed adjacent the lower surface of the housing. Two suction motors are secured in the interior cavity of the housing, each of the suction motors communicating with one of the suction inlets of the discharge tank such that a vacuum is created within the discharge tank and the suction conduits. Discharge fluids are drawn from the surface of a carpet via the suction conduits into the fluid inlets of the discharge tank.

The cleaning system has a head to which water is applied for cleaning carpets, etc. The head has a water nozzle for injecting hot water on the carpet, etc. and a vacuum inlet with vacuum hose coupled to a vacuum container. A lid having an outlet is provided for covering the top of the container. A hose is connected to the lid outlet and to a vacuum blower. A lid conduit forming the lid outlet extends through the lid with inlet openings formed through the lower portion of the outlet conduit. A chamber extends from the lower side of the lid surrounding the lower portion of the lid conduit with a bottom wall located below the lower portion of the lid conduit. A plate is connected to the bottom of the lid conduit and extends outward forming a dead space between the plate and the bottom wall of the chamber. An opening is formed through the side wall of the chamber for passage of air from the container into the chamber and to the vacuum device. The dead space is employed to keep water from passing to the vacuum blower.

A pressure washer sprays a pressurized liquid into a groove of a pavement, floor or similar surface to remove dirt and debris from the groove. The dirt and debris dissolves and/or becomes suspended in the liquid and is then removed from the pressure washer for disposal. The pressure washer includes a cleaning hood with a cover plate and a skirt that extends downward from the periphery of the cover plate to form a less than air tight seal with the surface containing the groove. A spray nozzle in a forward portion of the cover plate directs the pressurized liquid spray downward into the groove, where the liquid picks up dirt and debris to form a liquid suspension and/or solution, and preferably, rearward toward an exhaust port which removes the liquid suspension and/or solution of dirt and debris from the cleaning hood. A handle extends upward from the cleaning hood for guiding the pressure washer. The handle also carries a pressurized liquid supply line connected to the spray nozzle and a vacuum line connected to the exhaust port.

A system for cleaning carpets and other textiles utilizing an applicator wand with which a cleaning liquid is spray-applied to the carpet and with which the cleaning liquid and loosened debris are removed from the carpet under the influence of a vacuum created by a vacuum pump. The applicator wand includes an operator-controlled aerator valve through which air can be introduced into the flow of cleaning liquid routed to the dispensing nozzles of the wand to thereby permit an operator to readily adjust the condition of the liquid being applied to the carpet between an aerated and a non-aerated condition. In addition, the applicator wand utilizes a flow restrictor valve to limit the strength of the vacuum generated at the lower edges of the wand at an amount acceptable to pull a substantial amount of liquid from the carpet while preventing the creation of an undesirable seal between the lower edges of the wand and the carpet. In addition, a dryer attachment for use with the vacuum of the system utilizes a rotatable brush for disturbing the fibers of the carpet as the attachment is moved there across, an air-powered turbine for rotating the brush, and a blower and air-heating components for introducing heated air over the fibers of the carpet being disturbed by the brush.

While these portable surface cleaners may be suitable for the purposes for which they were designed, they would not be as suitable for the purposes of the present invention, as hereinafter described. It is thus desirable to provide a portable surface cleaning device consisting an external power washer and an external wet vac that attaches to the device. Also consisting a conduit that is secured to the housing and at one end may be coupled to an external power washer and at the other end, power spray jets whereby fluids may be ejected to the surface of a printing deck and may be mixed with cleaning fluid for the purpose of cleaning printers ink from said surface. Also consisting suction from an external wet vac to remove the fluid mix.

SUMMARY OF THE PRESENT INVENTION

The present invention discloses a high pressure printing press ink cleaner comprising a vacuum header housing having wheels secured thereon for mobility. A water supply conduit is connected at one end through connection means to the housing and at the other end to an external power washing device. The cleaning unit has a head thereon which contains power spray jets whereby fluid spray is ejected onto a surface to be cleaned. The dirty fluid is sucked up by suction ports contained in the vacuum head and returned through a hose to a wet vac where it is stored in the tank of the wet vac. An operator handle is shown having a control trigger means thereon which controls the release of the fluid and the amount of fluid to be released. An embodiment is also shown comprising a vacuum extension tube passing through multiple areas of a building having multiple connectors for the inlet water line and vacuum ports whereby one power washer and wet vac can be used to clean several areas simultaneously.

A primary object of the present invention is to provide a portable surface cleaning device consisting of an external power washer and an external wet vac.

Another object of the present invention is to provide a portable surface cleaning device consisting of a conduit that is secured to the housing at one end and may be coupled to an external power washer device. At the other end of the conduit attaching power spray jets whereby fluids may be ejected to the surface of a printing deck.

Yet another object of the present invention is to provide a portable surface cleaning device consisting of an external power washer having water that may be mixed with a cleaning fluid to assist in the removal of printers ink.

Still yet another object of the present invention is to provide a portable surface cleaning device consisting of an external wet vac that draws in the dirty fluid and stores it therein.

Yet another object of the present invention is to provide a portable surface cleaning device consisting of an external power washer having water that may be mixed with a cleaning fluid to assist in the removal of printers ink. Also to provide a portable surface cleaning device consisting of an external wet vac that draws in the dirty fluid and stores it therein.

Additional objects of the present invention will appear as the description proceeds.

The present invention overcomes the shortcomings of the prior art by providing a portable surface cleaning device consisting an external power washer and an external wet vac. Also to provide a portable surface cleaner consisting a conduit that is secured to the housing and at one end and may be coupled to an external power washer device. At the other end of the conduit attaching power spray jets whereby fluids may be ejected to the surface of a printing deck. Yet another object of the present invention is to provide a portable surface cleaner consisting an external power washer that the water may be mixed with a cleaning fluid to assist in the removal of printers ink.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
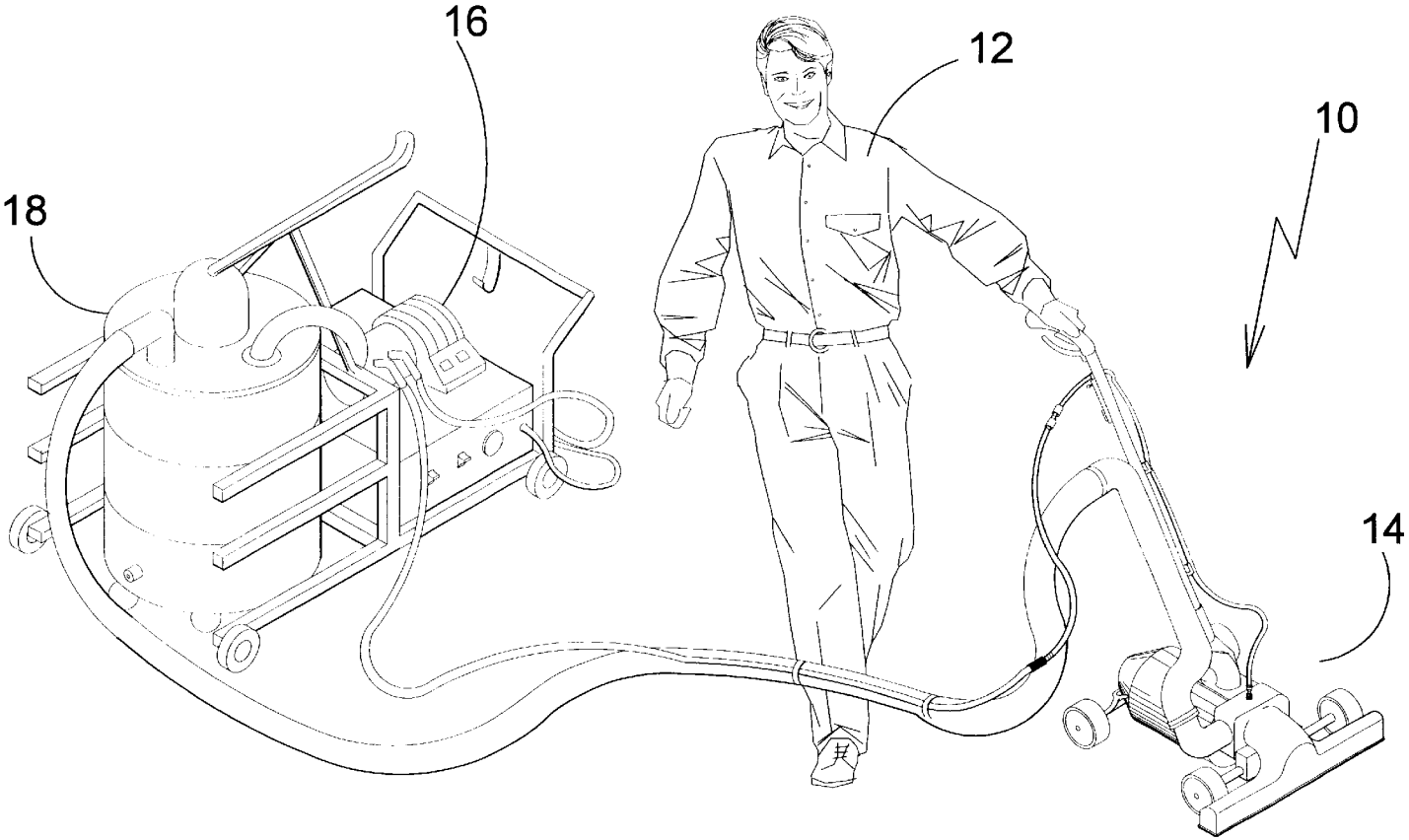
FIG. 1 is a pictorial illustration depicting the device of the present invention in use.

With regard to reference numerals used, the following numbering is used throughout the drawings.

| | |
|---|---|
| 10 | present invention |
| 12 | operator |
| 14 | cleaner |
| 16 | power washer |
| 18 | wet vac |
| 19 | wet vac tank |
| 20 | housing |
| 22 | wheels |
| 24 | water conduit |
| 26 | connection means |
| 28 | handle |

-continued

| | |
|---|---|
| 30 | trigger |
| 32 | wet vac attachment port |
| 34 | wet vac extension |
| 36 | wet vac extension attachment port |
| 38 | vacuum hose |
| 40 | pressure pump |
| 42 | pressure gauge |
| 44 | power cord |
| 46 | high pressure line |
| 48 | storage hook |
| 50 | handle |
| 52 | on/off switch |
| 54 | float switch |
| 56 | cart handle |
| 58 | cart wheel |
| 60 | arrow |
| 62 | water jets |
| 64 | arrow |
| 66 | squeegee |
| 68 | outbound spray |
| 70 | inbound mixture |
| 72 | suction port |
| 74 | head of vacuum |
| 76 | copper pipe |
| 78 | extension tube |
| 80 | wet vac port |
| 82 | pressure line port |
| 84 | pressure line extension tube |
| 86 | front wall |
| 88 | front wall |

DESCRIPTION OF THE PREFERRED EMBODIMENT(S)

In order that the invention may be more fully understood, it will now be described, by way of example, with reference to the accompanying drawings in which FIGS. 1 through 9 illustrate the present invention being a high pressure printing ink cleaner.

Turning to FIG. 1, shown therein is a pictorial illustration depicting the device of the present invention 10 in use. Shown is an operator 12 pushing the high pressure printing press ink cleaner 14, along with the power washer 16 and the wet vac 18.

Figure 2:
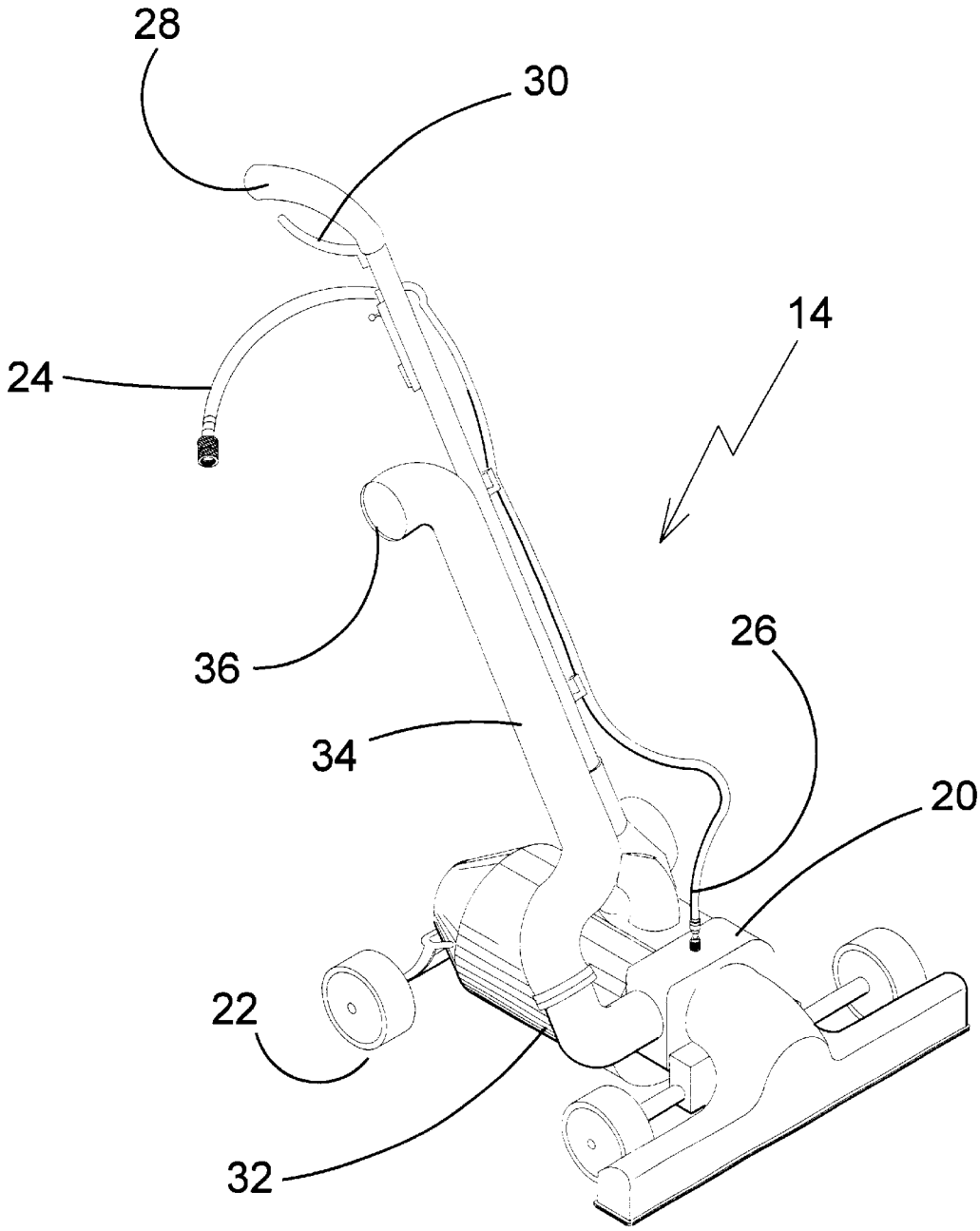
FIG. 2 is a perspective view of the present invention disconnected from the external wet vac and the external power washer.

Turning to FIG. 2, shown therein is a perspective view of the high pressure printing press ink cleaner 14 of the present invention disconnected from the external wet vac and the external power washer. Shown is the vacuum header housing 20 having secured thereon multiple wheels or casters 22 disposed on the lower surface of the housing 20. A conduit 24 being a high pressure water line is secured to the top of the housing through a means for connection 26 at one end and the conduit 24 may be coupled to an external power washer device (not shown) on the other end. An operator's handle 28 is disposed on the upper part of the housing and has disposed thereon a trigger 30 being a fluid release control trigger by which the operator may control the amount of fluid released by the cleaner 14. The suction port is contained on the underside of the housing with the suction port being coupled at the wet vac attachment port 32 through a conduit 34 to the wet vac extension attachment port 36 which is coupled to an external wet vac system (not shown) by means of a vacuum hose. The wet vac draws the discharge fluids up through the housing suction port and stores the fluid in a wet vac holding tank external from the device of the present invention.

Figure 3:
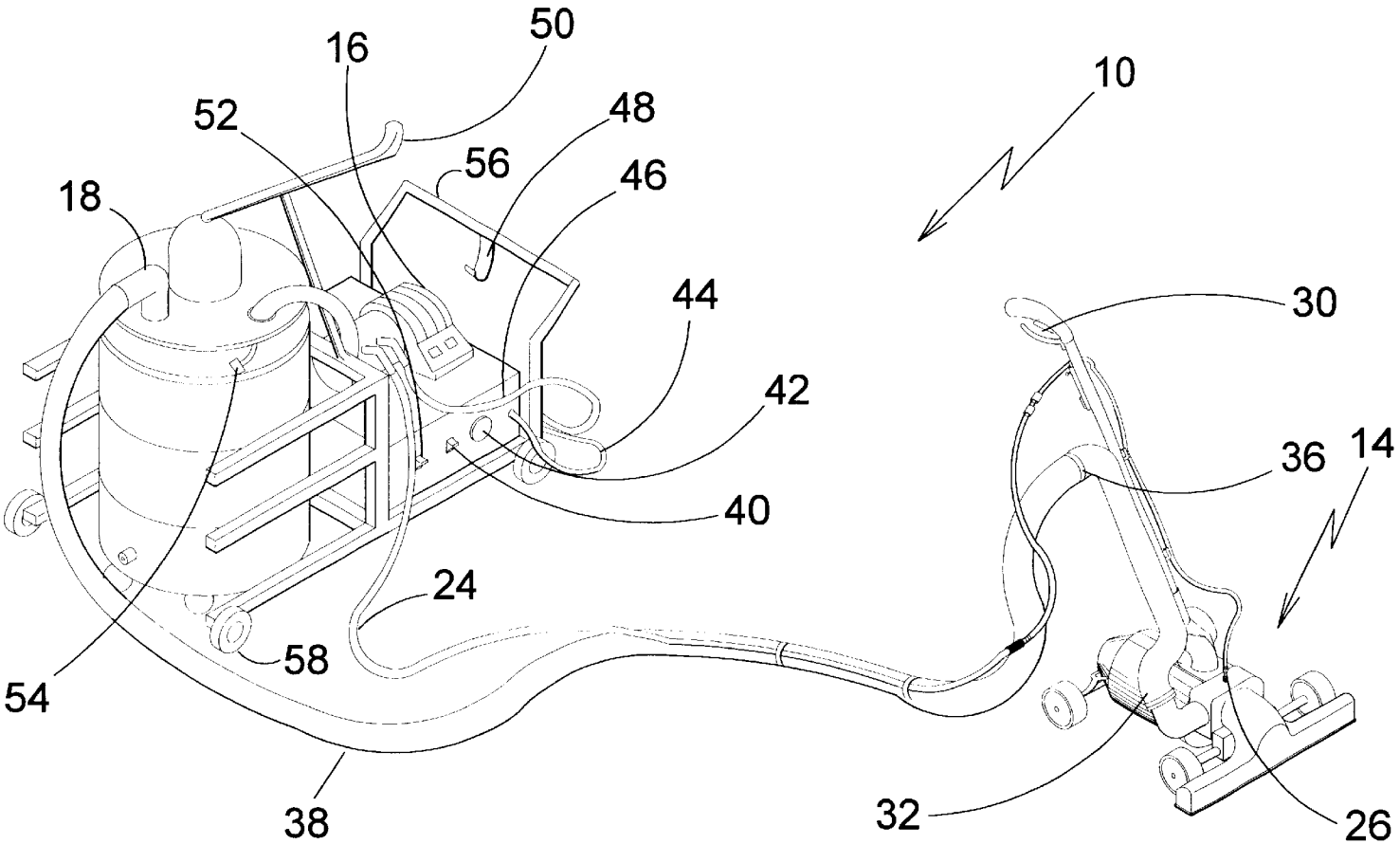
FIG. 3 is a perspective view of the present invention showing the high pressure hose from an external power washer and a hose line from an external wet vac coupled to ports on the housing of the present invention.

Turning to FIG. 3, shown therein is a perspective view of the present invention 10 showing the high pressure inlet line 24 from an external power washer 16 and a hose line 38 from an external wet vac 18 coupled to ports 32, 36 on the housing 20 of the present invention 10. Shown therein is the cleaner unit 14 which has been previously disclosed along with the power washer 16 and the wet vac 18. Also shown is the pressure pump 40 along with a pressure gauge 42. Also shown are the power cord 44 and the high pressure line 46 to the water tap along with a storage hook 48. Also shown is easy lift handle 50 along with an on/off switch 52 and an automatic float switch 54. The wet vac 18 and power washer 16 are mounted on a carriage 56 having wheels thereon 58 whereby the carriage or cart 56 can be moved about.

Figure 4:
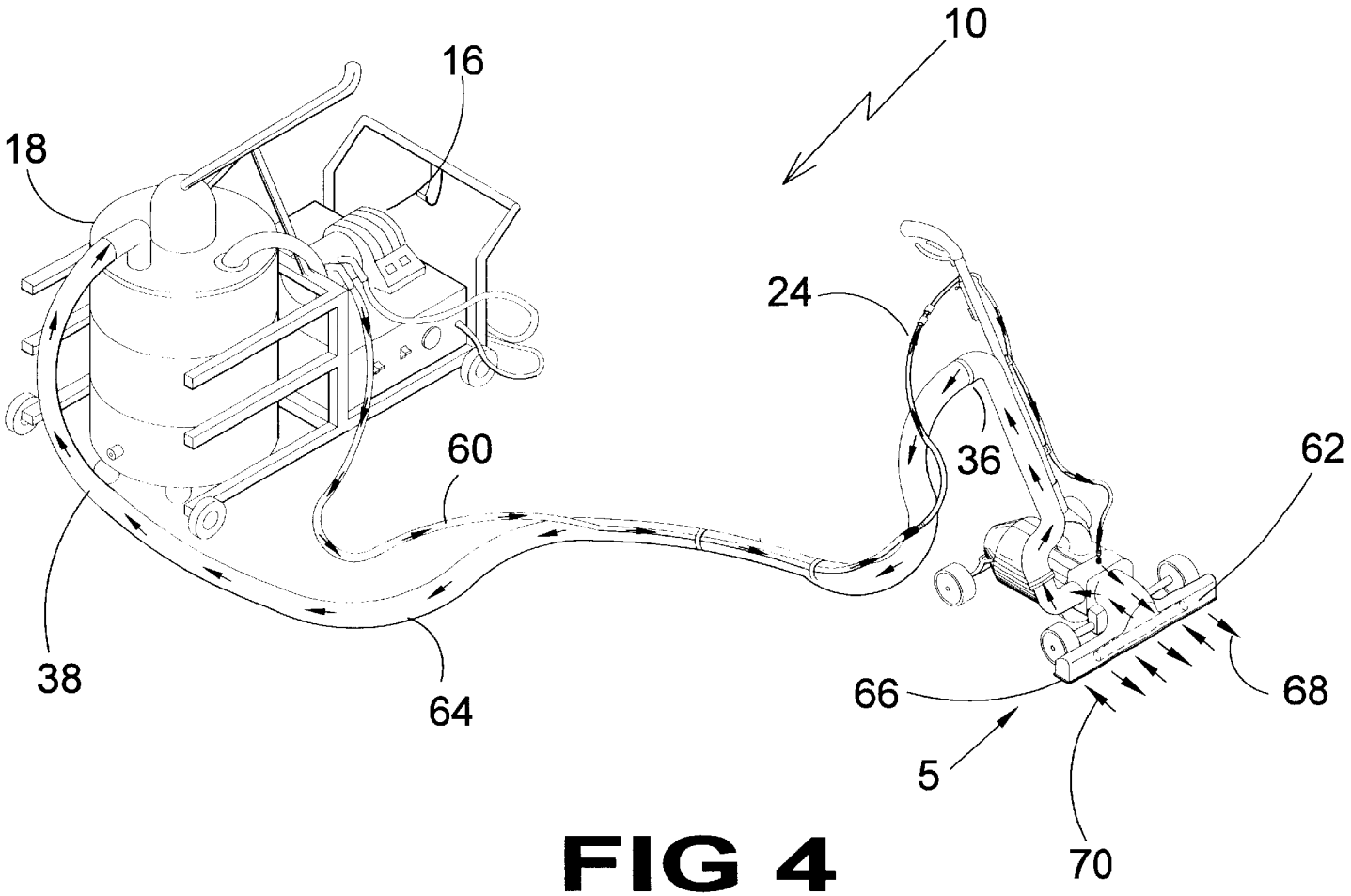
FIG. 4 is a perspective view of the present invention depicting water pressure coming from an external power washer through a high pressure hose to the housing to internal power jets as dispersed to a surface. Also shown is a wet vac hose coupled to a suction port on the housing of the present invention.

Turning to FIG. 4, shown therein is a perspective view of the present invention 10 depicting water pressure shown by arrows 60 coming from an external power washer 16 through a high pressure hose 24 to the housing 20 to internal power water jets 62 to be dispersed onto a surface. Also shown is a wet vac hose 38 returning water shown by arrows 64 coupled to a suction port 36 on the housing of the present invention 10. A squeegee 66 along with outbound water spray arrow 68 and inbound water and ink mixture arrow 70 are shown.

Figure 5:
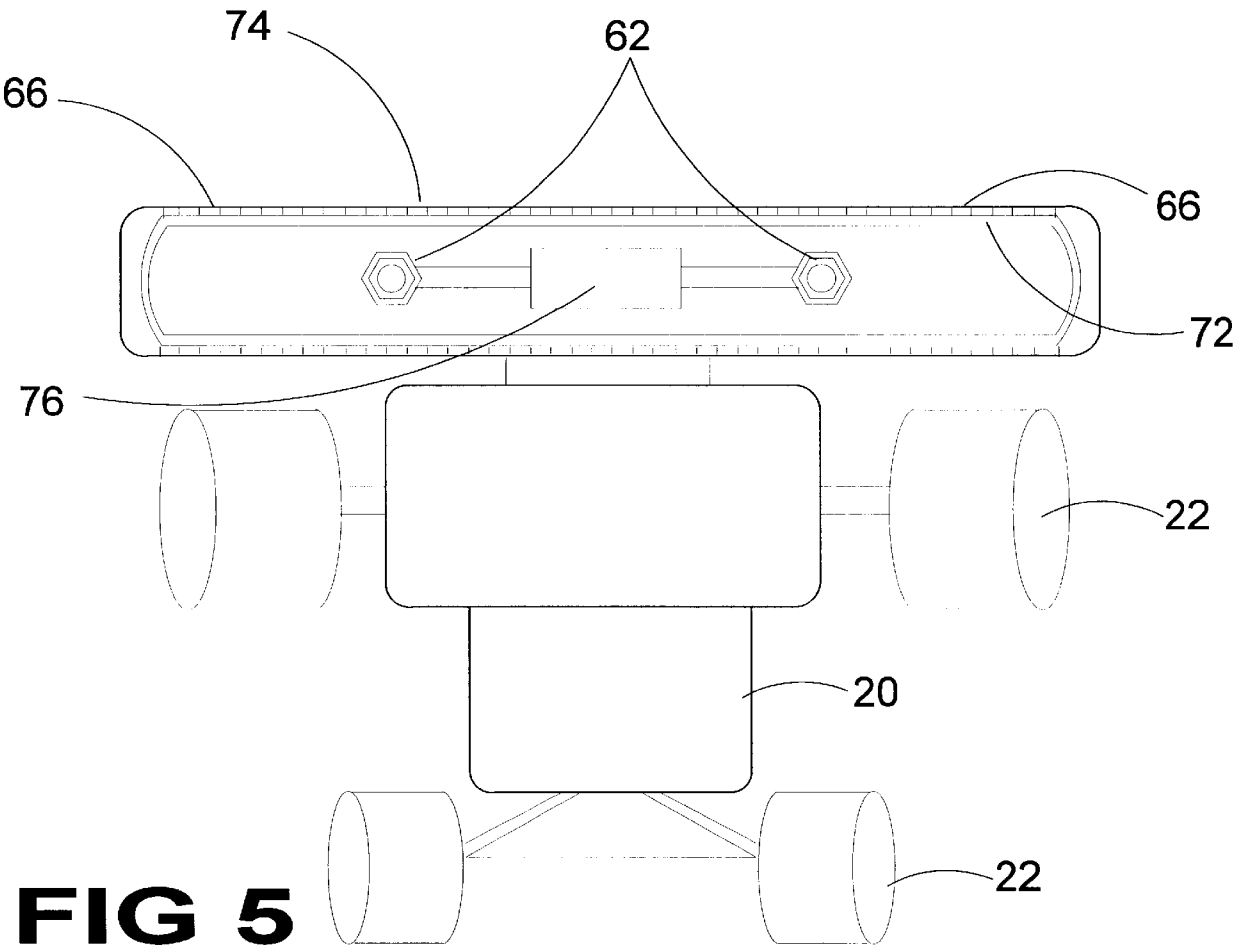
FIG. 5 is a bottom view of the housing of the present invention.

Turning to FIG. 5, shown therein is a bottom view of the housing 20 of the present invention. Shown therein are the multiple wheels 22 along with the squeegee 66 and the suction port 72 along with the high pressure water jets 62 mounted in the lower side of the head 74 of the housing having the copper pipe 76 connecting the water jets.

Figure 6:
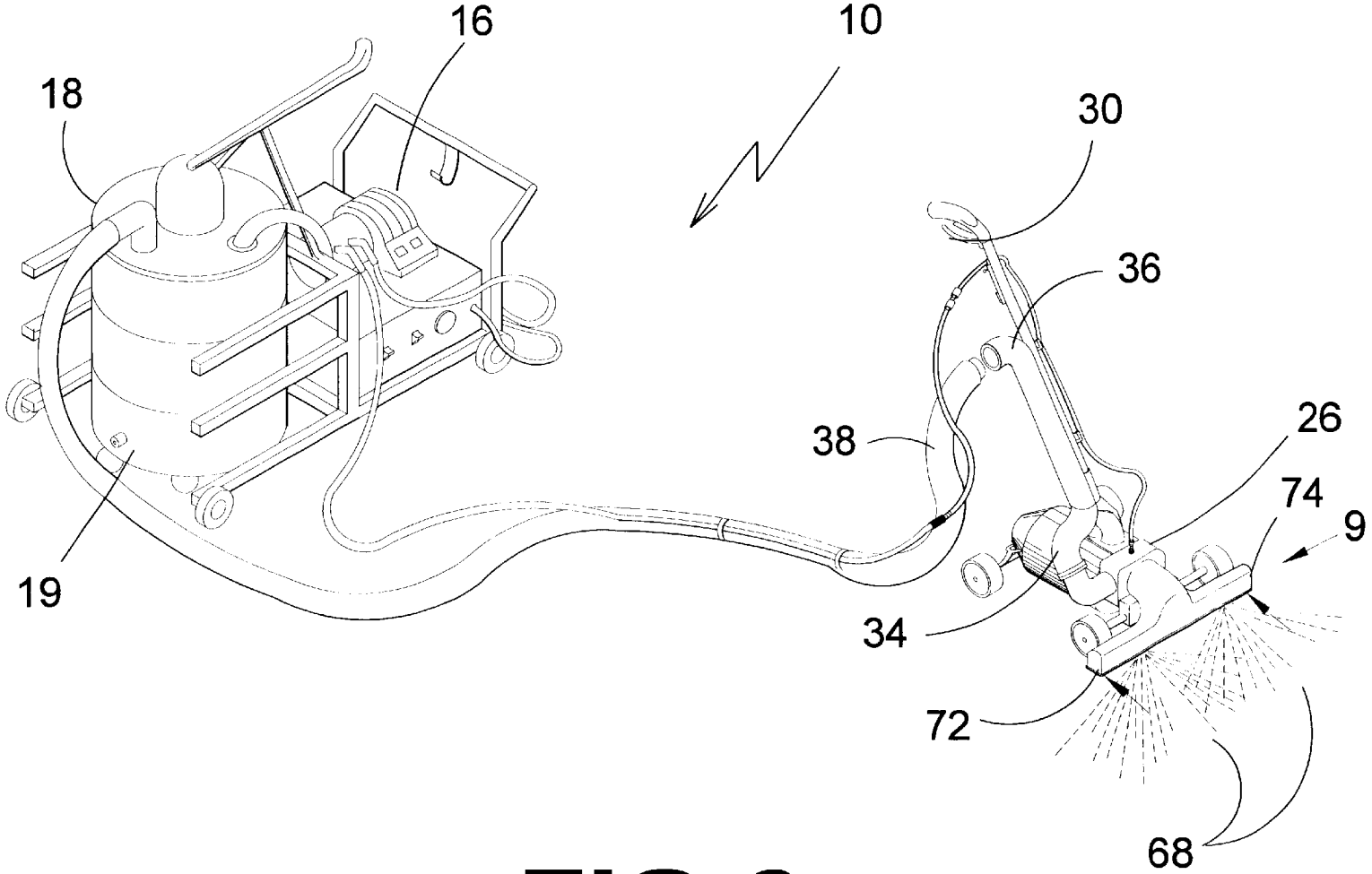
FIG. 6 is a pictorial view of the present invention depicting a water and detergent mix being dispersed for cleaning. Suction from the wet vac draws the dirty fluid up and into the wet vac tank and is stored there until emptying.

Turning to FIG. 6, shown therein is a pictorial view of the present invention 10 a water and detergent spray mix 68 being dispersed for cleaning from the head 74. Suction ports 72 with vacuum from the wet vac 18 draws the dirty fluid up and into the wet vac tank 19 and is stored therein until emptying. Other elements previously disclosed are also shown.

Figure 7:
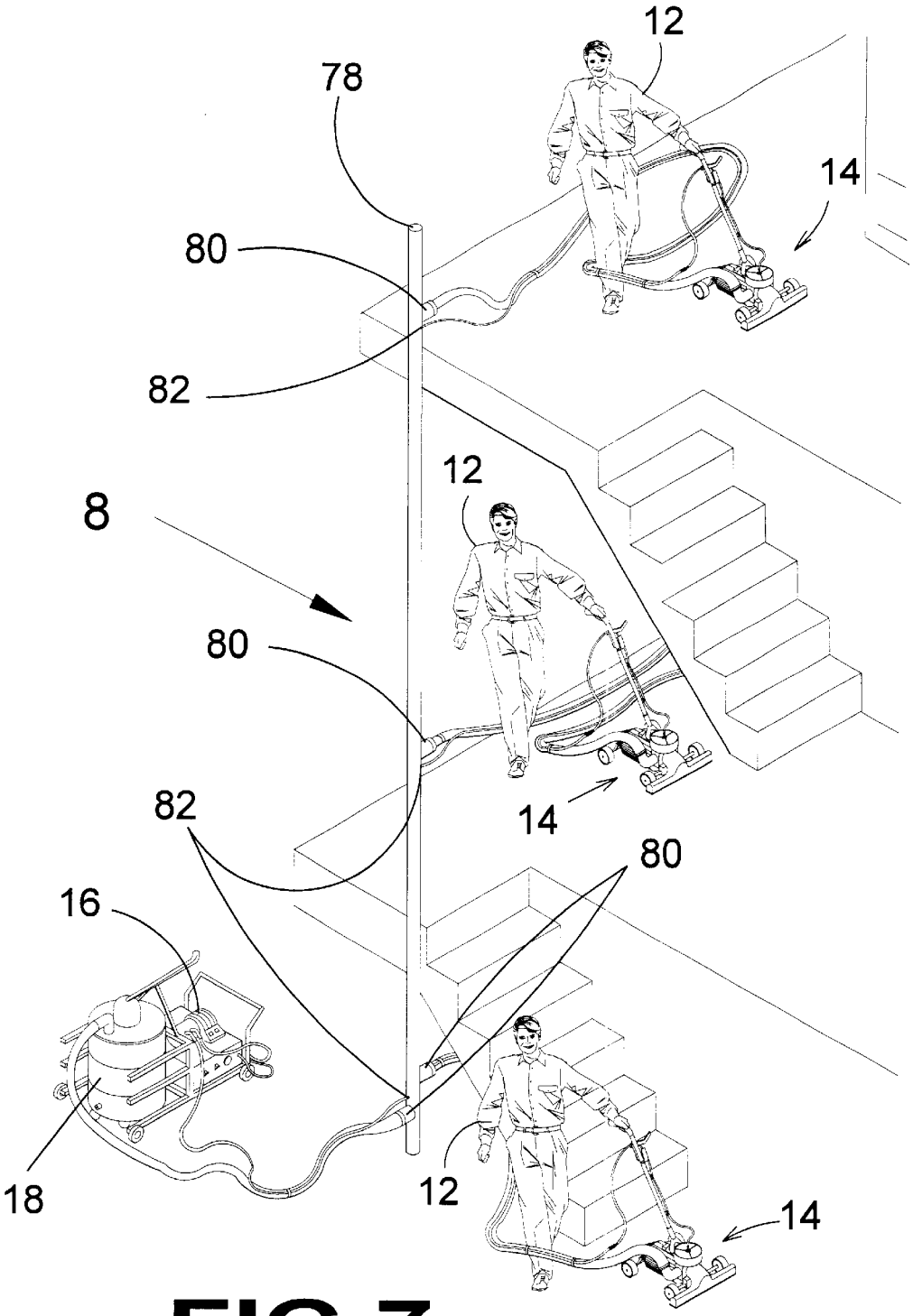
FIG. 7 is a pictorial illustration showing an extension tube which allows a worker access to connection ports located on several floors.

Turning to FIG. 7, shown therein is a pictorial illustration showing a vacuum extension tube 78 passing through multiple areas of a building which allows a worker 12 access to multiple wet vac connection ports 80 and high pressure ports 82 located on several floors of a building so that one power washer 16 and wet vac 18 can operate multiple high pressure cleaners 14 simultaneously.

Figure 8:
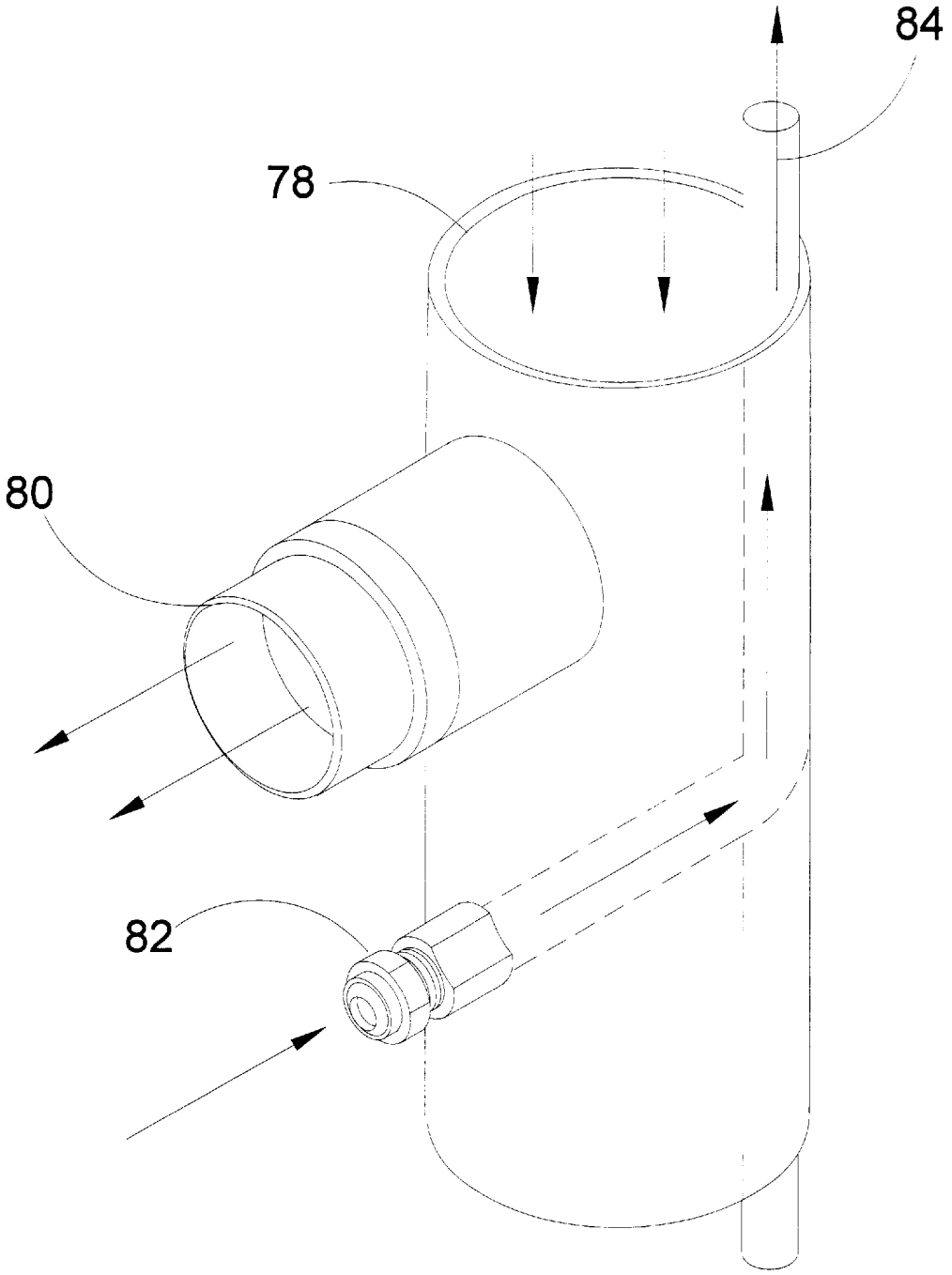
FIG. 8 is a detail illustration of a section of the extension tube showing the wet vac port and the power washer port.

Turning to FIG. 8, shown therein is a detail illustration of a section of the extension tube 78 showing the wet vac hose port 80 and the power washer hose port 82 which comprises a tube 84 which extends through extension tube 78.

Figure 9:
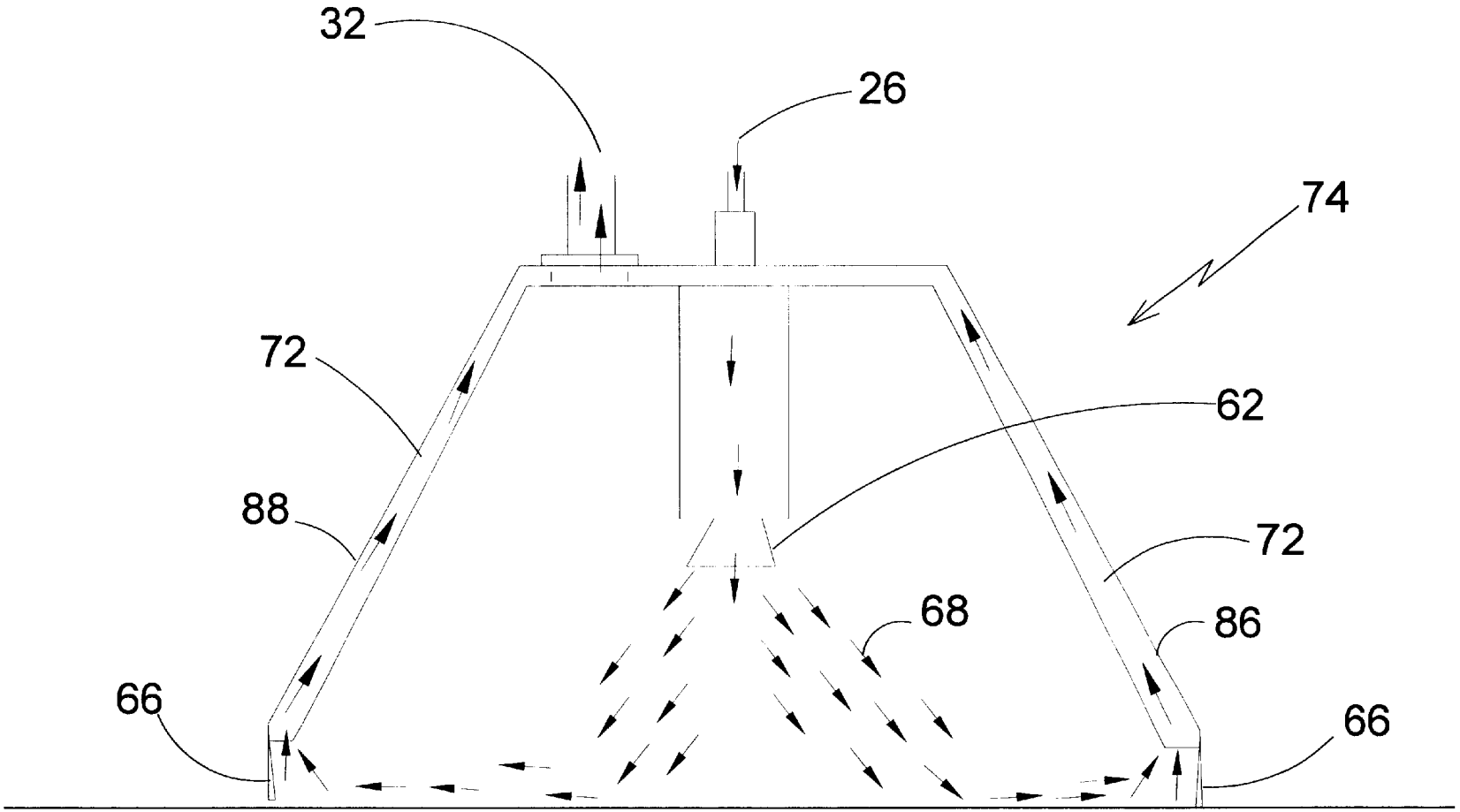
FIG. 9 is a cross sectional view of parts of the present invention.

Turning to FIG. 9, shown therein is a cross sectional view of vacuum head 74 showing various elements of the head 74 of the vacuum which have been previously disclosed. Head 74 has a front wall and a rear wall and is generally rectangular and is downwardly concave having an opening therein so that fluid can be sprayed onto the surface to be cleaned. Shown therein are the water jets 62 having the squeegees 66 disposed in walls 86, 88 on the lower edges of head 74 along with suction port or conduit 72 in walls 86, 88 which operate in response to the wet vac attachment port 32. Also shown is the connection means 26 from the water pressure line. Also shown are arrows 68 showing the water spray being emitted from the water jets 62 and then the dirty water being picked up by the suction port 72 and transmitted back to the wet vac.

What is claimed to be new and desired to be protected by Letters Patent is set forth in the appended claims.

I claim:

1. An apparatus for cleaning a surface, the apparatus being controlled by an operator, comprising:

a) a housing, said housing having a plurality of wheels disposed thereon so that said housing can be moved about, said housing having a front end;

b) a handle disposed on said housing so that the operator can move said housing about, said handle being upstanding and elongated;

c) a vacuum head disposed on said front end of said housing;

d) means comprising a fluid jet disposed in said vacuum head whereby cleaning fluid can be applied to the surface to be cleaned;

e) means comprising a suction port disposed in said vacuum head whereby the dirty cleaning fluid can be picked up from the surface to be cleaned;

f) means comprising a pressurized fluid supply whereby fluid is supplied to said vacuum head;

g) means comprising a vacuum source whereby fluid is removed from the surface to be cleaned;

h) said housing further comprising means for connecting said pressurized fluid supply thereto and means for attaching said vacuum source thereto, said connecting means including an inlet hose and said attaching means includes an outlet hose;

i) said handle further comprises a trigger means whereby the inlet fluid flow can be controlled;

j) said pressurized fluid supply means further comprises a power washer, said power washer being connected to said inlet hose;

k) said vacuum source means further comprises a wet vac, said wet vac being connected to said outlet hose;

l) said power washer and said wet vac are disposed on a carriage, said carriage having multiple wheels disposed thereon so that said carriage can be moved about, said carriage having a handle thereon for use by the operator;

m) said power washer further comprises a water supply, said power washer further comprises a pressure pump disposed thereon whereby a pressurized water supply is provided; and n) said wet vac further comprises a tank for storing therein the fluid removed form the surface to be cleaned, said tank further comprises a float switch disposed therein.

2. The apparatus of claim 1, wherein said vacuum head further comprises a downwardly concave enclosure being generally rectangular shaped, having an opening therein so that fluid can be placed on and vacuumed from the surface to be cleaned, said enclosure having a front wall and a rear wall thereon.

3. The apparatus of claim 2, wherein said fluid jet is disposed internal said enclosure whereby fluid can be sprayed onto the surface to be cleaned.

4. The apparatus of claim 3, wherein said suction port is disposed internal said front wall and said rear wall of said enclosure whereby fluid can be suctioned up from the surface to be cleaned.

5. The apparatus of claim 4, wherein said enclosure further comprises a squeegee disposed on said front wall and said rear wall of said enclosure.

6. The apparatus of claim 1, further comprising a vacuum extension tube, said tube extending into multiple areas of a building having multiple surfaces to be cleaned, said tube having multiple wet vac ports disposed thereon and multiple pressure line fluid ports disposed thereon so that multiple areas of a building can be cleaned simultaneously.

7. The apparatus of claim 6, wherein said vacuum extension tube further comprises a pressure line extension tube disposed therein, said pressure line extension tube having said multiple pressure line fluid ports disposed thereon.

* * * * *